US006144819A

United States Patent [19]

Nishiuwatoko

[11] Patent Number: 6,144,819

[45] Date of Patent: Nov. 7, 2000

[54] APPARATUS FOR APPLYING VOLTAGE TO CHARGING MEMBER AND CHARGING APPARATUS

[75] Inventor: Tsutomu Nishiuwatoko, Kashiwa, Japan

[73] Assignee: Canon Kabushiki Kaisha, Tokyo, Japan

[21] Appl. No.: 09/213,861

[22] Filed: Dec. 17, 1998

[30] Foreign Application Priority Data

Dec. 22, 1997 [JP] Japan ..... 9-365595

[51] Int. Cl.[7] ..... G03G 15/00

[52] U.S. Cl. ..... 399/90; 399/115; 399/176; 361/225

[58] Field of Search ..... 399/90, 25, 88, 399/89, 100, 111, 115, 116, 117, 121, 174, 176; 361/221, 225; 439/13, 18, 29

[56] References Cited

U.S. PATENT DOCUMENTS 5,697,020 12/1997 Sato et al. ..... 399/100
5,768,660 6/1998 Kurihara et al. ..... 399/111

FOREIGN PATENT DOCUMENTS 0 854 392 7/1998 European Pat. Off. .

*Primary Examiner*—William Royer
*Assistant Examiner*—Huan Tran
*Attorney, Agent, or Firm*—Fitzpatrick, Cella, Harper & Scinto

[57] ABSTRACT

A voltage applying apparatus for applying from a power source a voltage to a rotatable charging member for charging a body to be charged, includes first and second conductive members brought into contact with a peripheral surface of a rotary shaft of the charging member to form a first electric supply path for applying the voltage to the peripheral surface of the rotary shaft through the first conductive member from the power source, and to form a second electric supply path for applying the voltage to the peripheral surface of the rotary shaft through the second conductive member from the power source. A first portion at which the first conductive member is brought into contact with the peripheral surface of the rotary shaft and a second portion at which the second conductive member is brought into contact with the peripheral surface of the rotary shaft, are so provided as to be overlapped with each other in an axial direction of the rotary shaft.

27 Claims, 11 Drawing Sheets

APPARATUS FOR APPLYING VOLTAGE TO CHARGING MEMBER AND CHARGING APPARATUS

BACKGROUND OF THE INVENTION

1. Field of the Invention

The present invention relates to an apparatus for applying a voltage to a charging member for charging a body to be charged with electrostatic charge such as a photosensitive body and a dielectric body, and to a charging apparatus provided with this voltage applying apparatus. The charging apparatus is suitable for use in an electrophotography type copying machine, an image forming apparatus such as a printer, and a process cartridge.

2. Related Background Art

In an image forming apparatus using an electrophotographic process, an image bearing member defined as a photosensitive body is selectively exposed to the light, thereby forming a latent image. The latent image is developed by a developing agent (toners), the developed image is then transferred onto a recording medium (paper and OHT, etc), and further the transferred image is fixed onto the recording medium, thus forming the image.

The toners residual on the surface of the photosensitive body with a completion of the image transfer, is scraped off by a cleaning unit, thereafter the photosensitive body surface is uniformly charged to a predetermine polarity, and at a predetermined electric potential by a charging unit, and the photosensitive body is again subjected to the photosensitive process.

A corona charger has hitherto been increasingly used as the charging unit of the image forming apparatus described above. This is used so that the corona charger is disposed in a face-to-face/non-contact relationship with the photosensitive body, of which the surface is exposed to the corona discharge generated by the corona charger, whereby the surface of the photosensitive body is charged to the predetermined polarity, and at the predetermined electric potential.

Further, in recent years, there has been utilized a contact type used for a charging apparatus in which the charging member is brought by pressure into contact with the photosensitive body because of its having such advantages that it needs lower ozone and smaller electric power than the corona charger.

The contact type charging apparatus is, as in a first conventional art example shown in FIG. 9, constructed such that the charging member involves the use of a charging roller 31, including a core bar 31*a*, of which a surface layer is laminated with a conductive elastic layer 31*b* and a high-resistance elastic layer 31*c*. The core bar 31*a* is rotatably held by a holding member 500 composed of a conductive material. The charging roller 31 is biased toward the photosensitive body by a resilient a coil spring member 501 so provided as to be contactable between the holding member 500 and an electrode 22, fixedly supported by an apparatus box body or the like, and is thus brought by a predetermined pressure into contact with the photosensitive body, and then charging roller 31 is rotationally driven with rotations of the photosensitive body. Next, a bias voltage is applied to the charging roller 31, via the coil spring 501 and the holding member 500, from the electrode 22, which is connected to the power source, thus executing a charging process.

Moreover, with a higher-speed operation and a longer life-time of the cartridge, an apparatus for effecting the charging process through a plurality of routes has recently been proposed in order to supply the charging roller 31 with the electricity more surely.

A second conventional art example as, shown in, FIG. 10, is that the coil spring 501, as in the first prior art example, biases the holding member 500 composed of the conductive material, for rotatably supporting the charging roller 31, thereby pressing the charging roller 31 against the photosensitive body. The second prior art example, however, is such a contrivance that an arm member 501*a* provided at one end of the coil spring 501 comes into contact with the core bar 31*a* of the charging roller 31. The bias voltage is applied to the coil spring 501, whereby the electricity can be supplied via two routes, i.e., a first electric supply path for applying the bias voltage to the charging roller 31 through the coil spring 501 and the holding member 500, and a second electric supply path for applying the voltage to the charging roller 31 through the arm member 501*a* of the coil spring 501. (U.S. Pat. No. 5,768,660).

Moreover, a third conventional art example shown in FIG. 11 has such a construction that uses a conductive holding member 500 having a shaft member 500*a* provided with a coil spring fitting portion 500*b* at its front end. A charging roller contact 504 composed of a conductive material and having contact points 504*a* coming into contact with a peripheral surface of a shaft 31*a* of the charging roller 31, and a double coil spring 505 coaxially provided with coil spring portions different in diameter. Next, the charging roller contact 504 is fitted to a shaft member 500*a* of the holding member 500, and the double coil spring 505 is fitted to the coil spring fitting portion 500*b* of the shaft member 500*a*. The holding member 500 is biased toward an image carrier by a first spring portion 505*a* of the double coil spring 505, and the charging roller contact 504 is biased toward the charging roller 31 by a second spring portion 505*b* of the double coil spring 505. A bias voltage is applied to the double coil spring 505, whereby the bias voltage can be applied to the charging roller 31 through two routes, i.e., a first electric supply path via the double coil spring 505, the holding member 500, and a second electric supply path via the double coil spring 505 and the charging roller contact 504. (EP-A-854,392)

Problems inherent in the conventional art described above will be explained.

For instance, in the charging apparatus, using the first electric supply path via the holding member 500 from the coil spring 501 and the second electric path in which the arm member 501*a* extending from one end of the coil spring 501 is brought into contact with the core bar 31*a* of the charging roller 31, as exemplified in the second conventional art example shown in FIG. 10, it is required that the core bar 31*a* of the charging roller 31 can be set comparatively long in order to make the arm member 501*a* abut against the core bar 31*a* of the charging roller 31, which results in such a problem that an entire length of the apparatus increases.

On the other hand, in the charging apparatus using the first electric supply path via the holding member 500, from the double coil spring 505 and the second electric supply path via the charging roller contact 504 from the double coil spring 505, as exemplified in the third conventional art example shown in FIG. 11, because of using the double coil spring 505, in which the spring portions are different in diameter, are coaxially provided. The problem is that the total height of the apparatus increases, corresponding to a set length of the double coil spring 505 and the second spring portion 505*b* and then to a wall thickness of the charging roller contact 504.

Further, the concerns about the environmental issues have increasingly grown in recent years, and hence the components of the apparatuses have been required to be reused. However, in the conventional charging apparatus, a portion of the charging roller on the side opposite to the photosensitive body with respect to a central axis of the charging roller causes frictions at its contact portion with the holding member while receiving a biasing force of the coil spring, which might therefore bring about an easy occurrence of an abrasion of the contact portion. This has been an obstacle in terms of reusing the parts.

SUMMARY OF THE INVENTION

Accordingly, it is a first object of the present invention to provide an apparatus for applying a voltage to a charging member and a charging apparatus which are capable of ensuring an electric supply to the charging member by forming a plurality of electric supply paths.

It is a second object of the present invention to provide an apparatus for applying a voltage to a charging member and a charging apparatus which is capable of downsizing the apparatus by overlapping a contact position of a first member upon the charging member with a contact position of a second member upon the charging member in a longitudinal direction of the charging member.

It is a third object of the present invention to provide an apparatus for applying a voltage to a charging member and a charging apparatus which is capable of eliminating a necessity for a member, such as a spring for biasing a second member, when bringing the second member into contact with the charging member, by making the second member contact with the charging member due to an elastic deformation of the second member itself, and thus facilitating the downsizing of the apparatus.

It is a fourth object of the present invention to provide an apparatus for applying a voltage to a charging member and a charging apparatus which is capable of preventing an abrasion of the second member by abutting the second member against the charging member with a predetermined pressure without depending on a resilient force of the elastic member, and thus facilitating the reuse thereof.

These together with other objects and advantages which will be subsequently apparent, reside in the details of construction and operation which is more fully described and claimed hereinafter, reference being had to the accompanying drawings forming a part hereof, wherein like numerals refer to like parts throughout.

DETAILED DESCRIPTION OF THE PREFERRED EMBODIMENTS

Embodiments of the present invention will hereinafter be described with reference to the accompanying drawings.

EMBODIMENT 1

1. Outline of Construction of Image Forming Apparatus

An embodiment 1 of the present invention will be discussed with reference to FIGS. 1 and 2.

Figure 1:
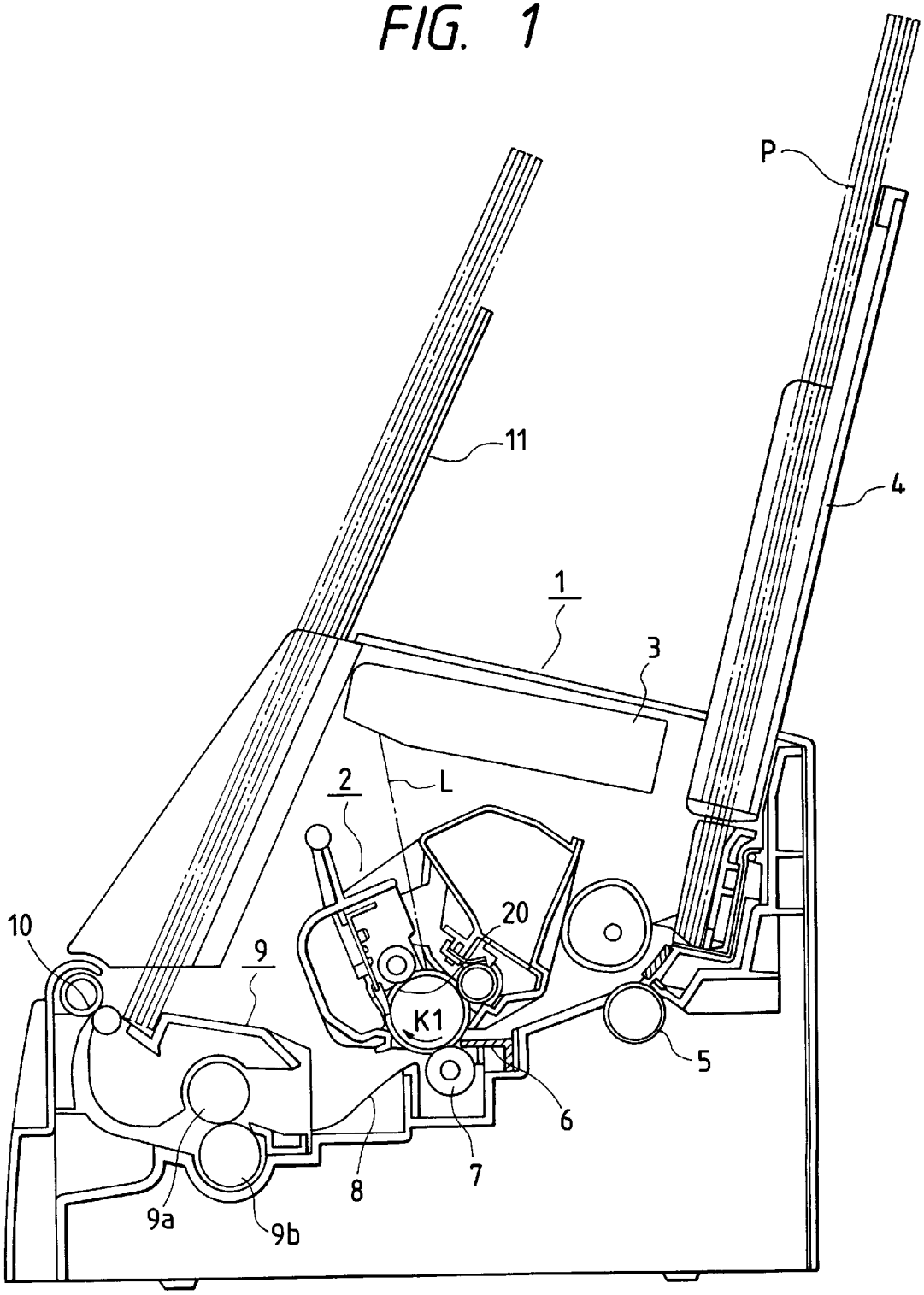
FIG. 1 is a schematic sectional view showing an image forming apparatus in an embodiment of the present invention.

FIG. 1 schematically shows an image forming apparatus 1 according to the present invention, and a process cartridge 2. This image forming apparatus 1 is classified as a laser beam printer utilizing an electrophotographic process, into which the process cartridge 2 is loaded.

When the process cartridge 2 is loaded into the image forming apparatus body 1, a laser scanner unit 3 serving as the principal unit of an exposure apparatus is disposed above the process cartridge 2, and a sheet tray 4 stacked with sheets P on which images are to be formed, is disposed behind, (on the right side in FIG. 1), the process cartridge 2. Further, the image forming apparatus body 1 incorporates a sheet feeding roller 5, a transfer guide 6, a transfer charging roller 7, a fixing unit 9, a sheet discharging roller 10 and a discharged sheet tray 11, all of which are disposed sequentially in a conveying direction of the sheet P.

Figure 2:
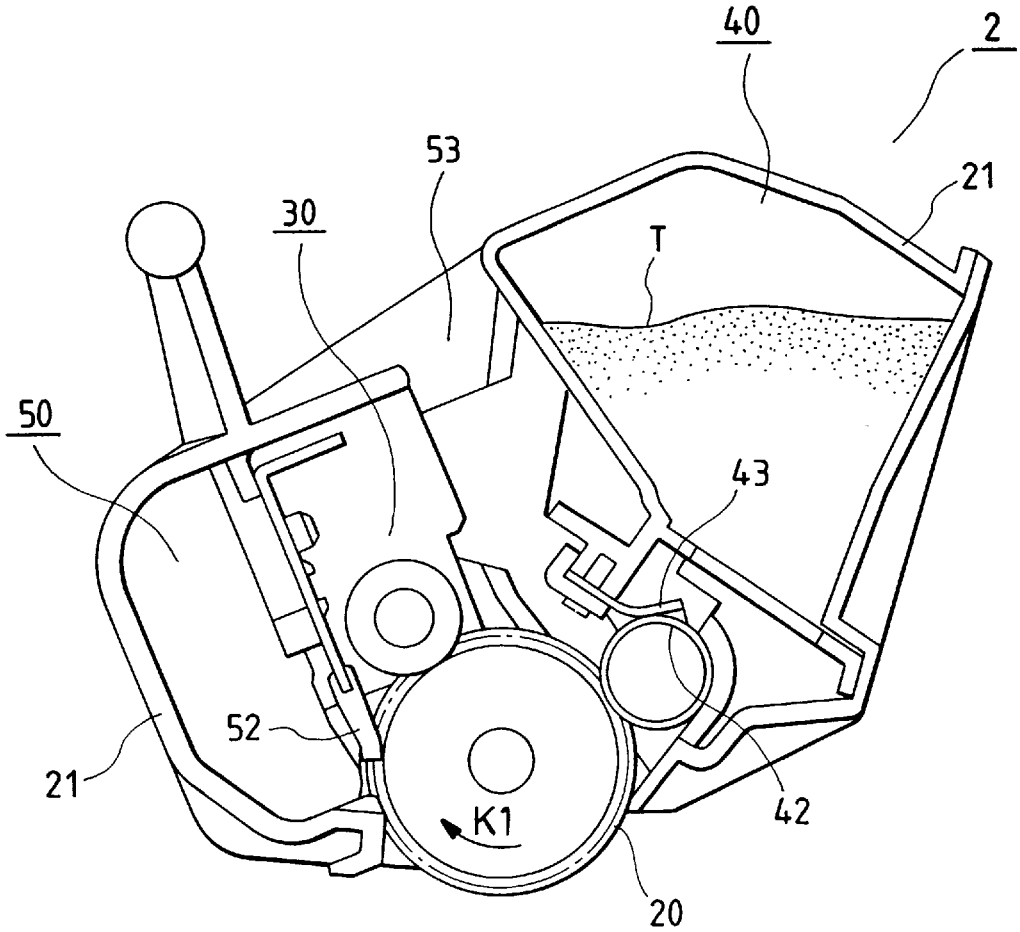
FIG. 2 is a schematic sectional view illustrating a process cartridge in the embodiment.

The process cartridge 2 has, as illustrated in FIG. 2, a cartridge frame 21 integrally containing four types of process units, such as a rotatable photosensitive body 20 serving as an image bearing member, a charging unit 30, a developing unit 40 and a cleaning unit 50. Note that it might be sufficient for the process cartridge 2 to include at least the photosensitive body 20 and the charging unit 30.

Next, a process of forming the image is briefed. Based on a print start signal, the photosensitive body 20 is rotationally driven at a predetermined peripheral speed (a process speed) in a direction indicated by an arrow K1. An outer peripheral surface of the photosensitive body 20 is uniformly charged by the charging unit 30.

The laser scanner unit 3 outputs a laser beam L modulated, corresponding to a time-series electric digital pixel signal of object image data. The laser beam L enters the cartridge body via an exposure window 53, which is formed in an upper surface of the cartridge body, and the outer peripheral surface of the photosensitive body 20 is thus exposed to and scanned by the laser beam L. An electrostatic latent image corresponding to the object image data is thereby formed on the outer peripheral surface of the photosensitive body 20.

This electrostatic latent image is developed by a developer (toners) T applied over a developer bearing member (a developing sleeve) 42, of which a layer thickness is restricted by a developer restriction member (a developing blade) 43, of the developing unit 40.

On the other hand, synchronizing with a laser output timing, the sheet P is supplied from the sheet tray 4 by the sheet feeding roller 5 to a transfer position between the photosensitive drum 20 and the transfer charging roller 7 via the transfer guide 6. In the transfer position, toner images existing on the photosensitive drum 20 are thereby sequentially transferred onto the sheet P.

The sheet P, onto which the toner images have been transferred, is separated from the photosensitive drum 20 and conveyed along a conveyance guide 8 to the fixing unit 9. The sheet P passes through a nip portion between a fixing roller 9*a* and a pressurizing roller 9*b*, whereby the toner images are subjected to a fixing process. Next, the sheet P is discharged by the sheet discharging roller 10 into the discharged sheet tray 11. Residual toners on the outer peripheral surface of the photosensitive body 20 after the transfer has been done, are scraped off by the cleaning blade 52 of the cleaning device 50, and the photosensitive body 20 again prepares for the image forming process starting from the charging process.

2. Charging Apparatus (Charging Unit)

Figure 3:
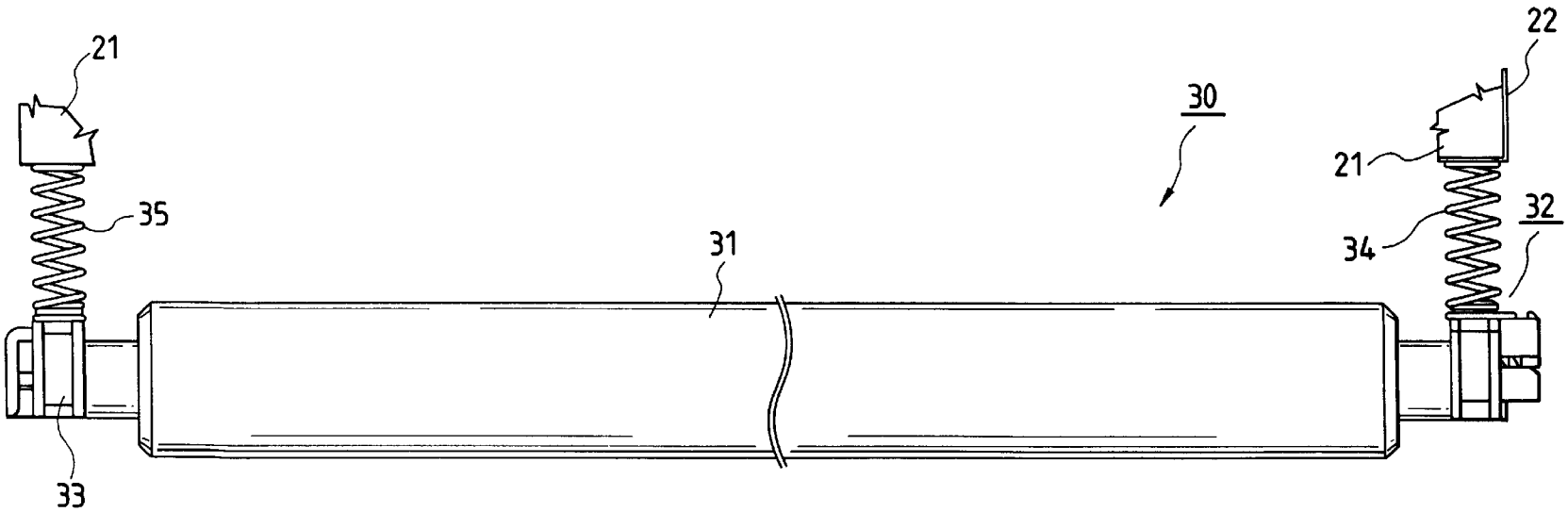
FIG. 3 is a side view showing a charging apparatus in the embodiment.
Figure 4:
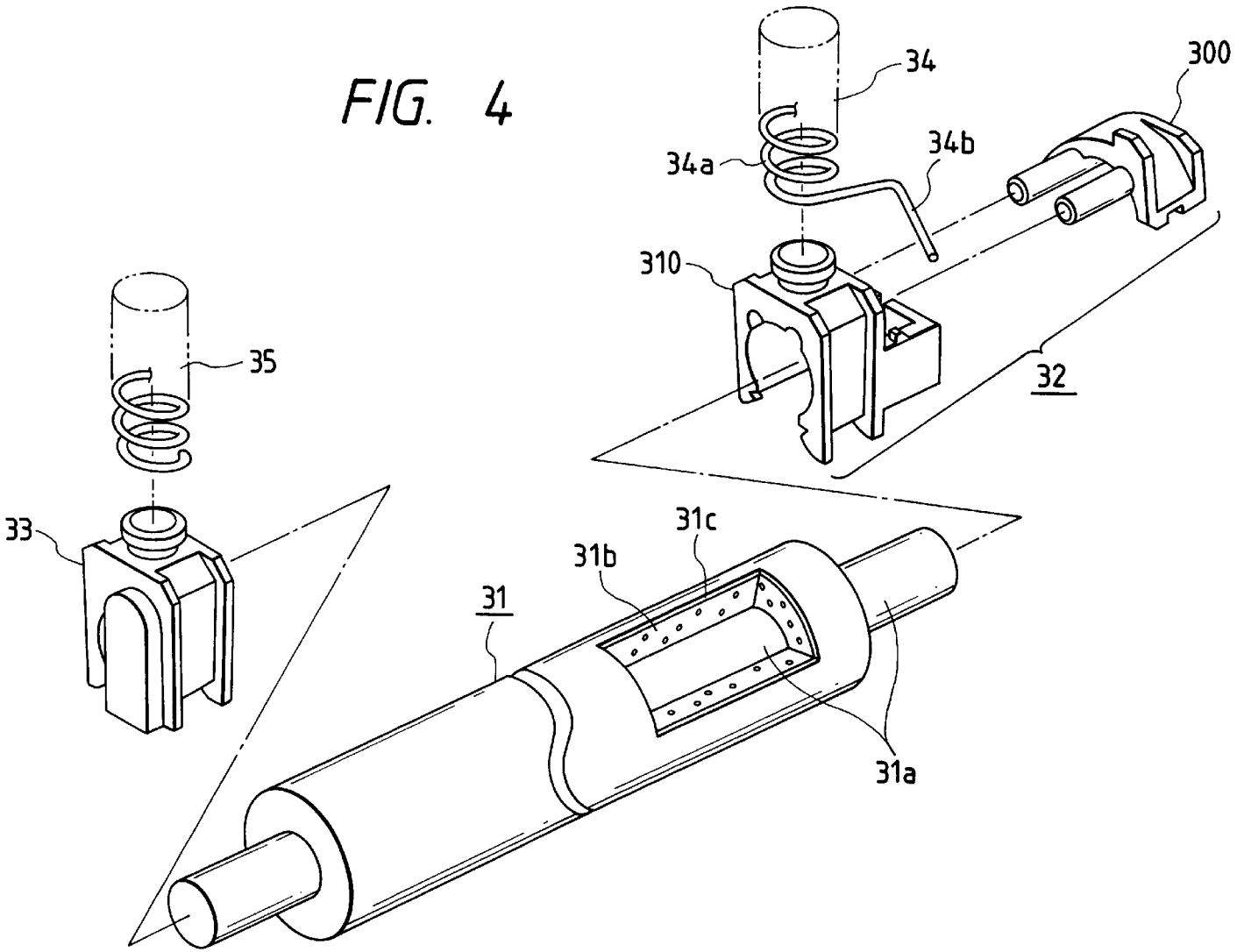
FIG. 4 is an exploded perspective view showing a construction of the charging apparatus in the embodiment.

Next, the charging apparatus in the Embodiment 1 will be explained referring to FIGS. 3 and 4.

The charging apparatus 30 is constructed of a charging member (a charging roller ) 31, constituting the principal portion of the charging apparatus 30, a holding member 32 for rotatably holding one end of the charging roller 31, a bearing 33 for rotatably supporting the other end of the charging roller 31, a conductive elastic member serving as a biasing member (a coil spring with an arm) 34, so disposed to be contractible between an electrode (an electric supply sheet metal) 22 attached to the cartridge frame 21 and the holding member 32, for biasing the holding member 32 toward the photosensitive body, and a coil spring 35, of which one end is secured to the cartridge frame 21, serving to bias the bearing 33 toward the photosensitive body. The coil spring 34 with the arm and the coil spring 35, acts to press the charging roller 31 by a predetermined resilient force against the photosensitive body 20 defined as a body to be charged. In forming the image, the charging roller 31 is driven to rotate with rotations of the photosensitive body 20, during which a bias voltage is applied to the charging roller 31 from the image forming apparatus body through the electric supply sheet metal 22, thereby executing a charging process.

The charging roller 31, constituting the principal portion of the charging apparatus 30, includes a core bar 31*a* such as SUS, a conductive elastic layer 31*b*, composed of carbon-added EPDM etc., formed in a central portion of the core bar 31*a*, and a high-resistance elastic layer 31*c* composed of carbon-added urethane rubber etc.

Next, the holding member 32 is described with reference to FIGS. 4, 5A, 5B, 6A, 6B, 7, 8A, 8B and 8C.

The holding member 32 is constructed of a first conductive member 300, composed of a conductive material such as carbon-added resin etc, and a second conductive member 310, composed of a conductive material such as carbon-added resin etc.

Figure 5B:
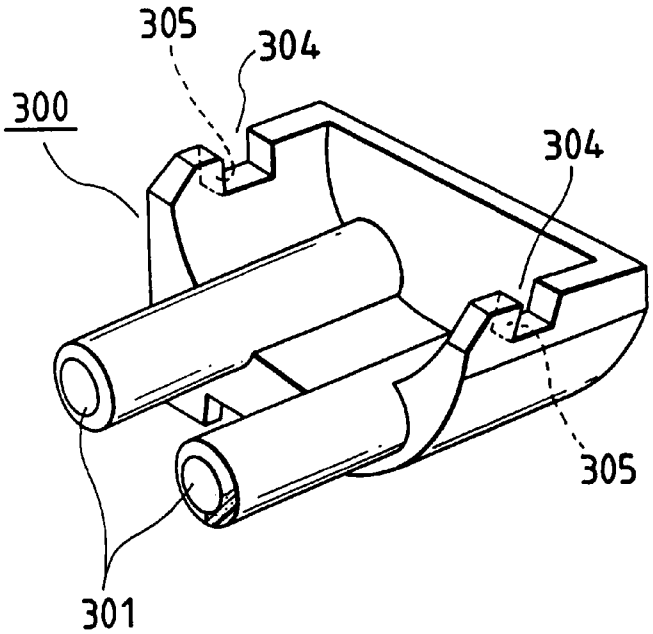
FIGS. 5B is another enlarged perspective view showing the first holding member in the embodiment.
Figure 5A:
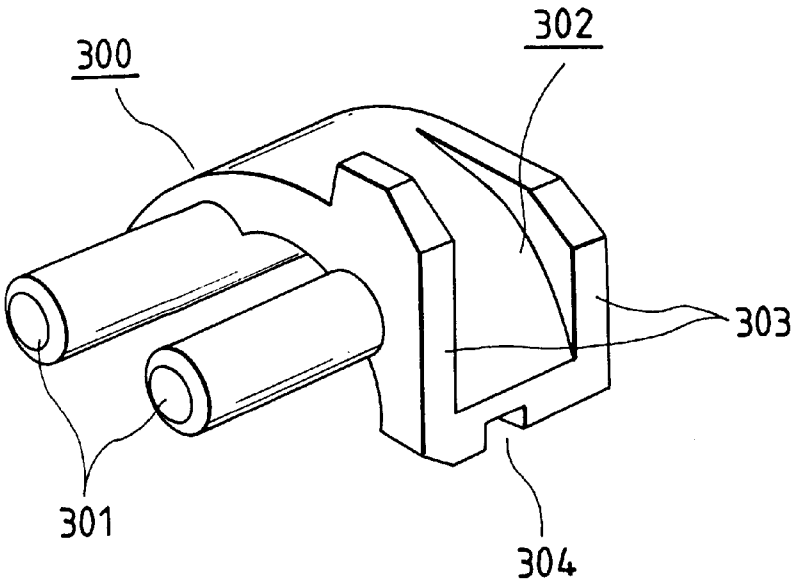
FIG. 5A is an enlarged perspective view showing a first holding member in the embodiment.

The first member 300 is formed integrally with a pair of charging roller contacting shafts 301 and a spring arm abutment portion 302, (FIGS. 5A and 5B). The spring arm abutment portion 302 is provided with a pair of spring arm regulating ribs 303. Further, a main portion of the first member 300, is formed with a groove 304 having an engagement surface 305 for engaging with the second member 310.

Figure 6B:
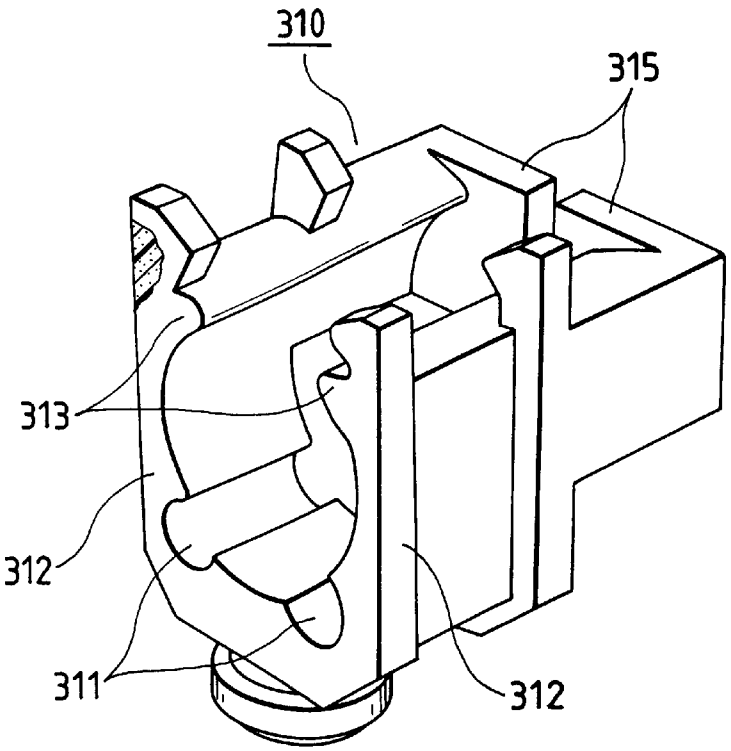
FIG. 6B is another enlarged perspective view showing the second holding member in the embodiment.
Figure 6A:
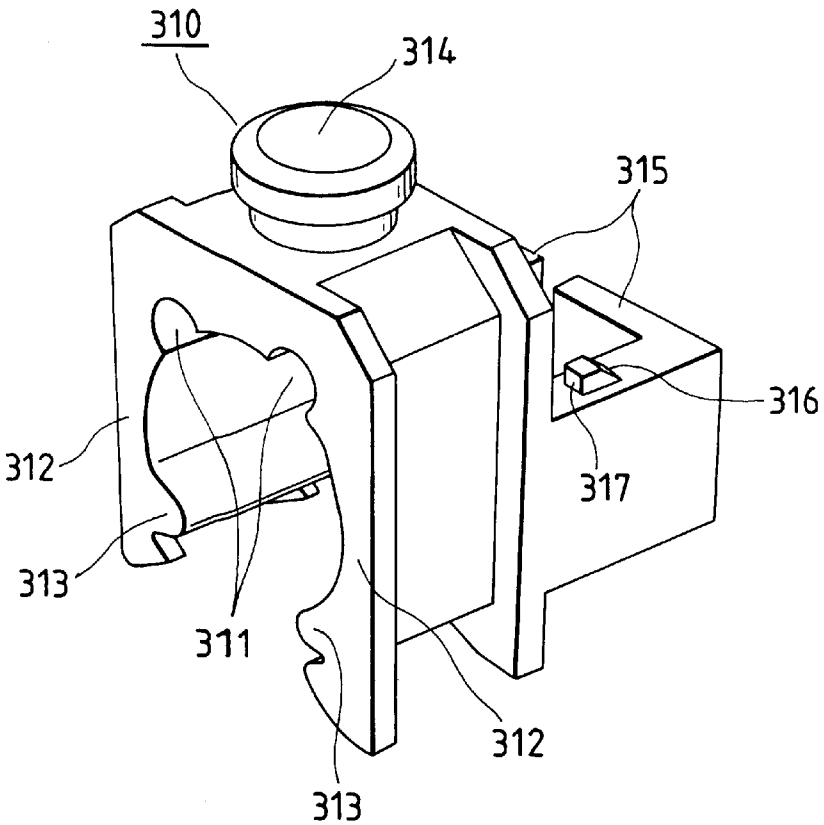
FIG. 6A is an enlarged perspective view showing a second holding member in the embodiment.

The second member 310 is formed integrally with a pair of fitting grooves 311, into which the pair of charging roller contacting shafts 301 of the first member 300 are fitted. A pair of shaft holding portions 312, for holding the core bar 31*a* of the charging roller 31 by catching it therebetween, and a coil spring fixing portion 314 to which a coil spring portion 34*a* of the coil spring 34 with the arm is secured (FIG. 6A). First contact portions (shaft contact portions) 313 brought into contact with the core bar 31*a* are provided, facing to each other at tips of the shaft holding members 312. Further, the second member 310 integrally has a stopper 315, and engagement pawls 316 provided on the stopper 315.

Figure 7:
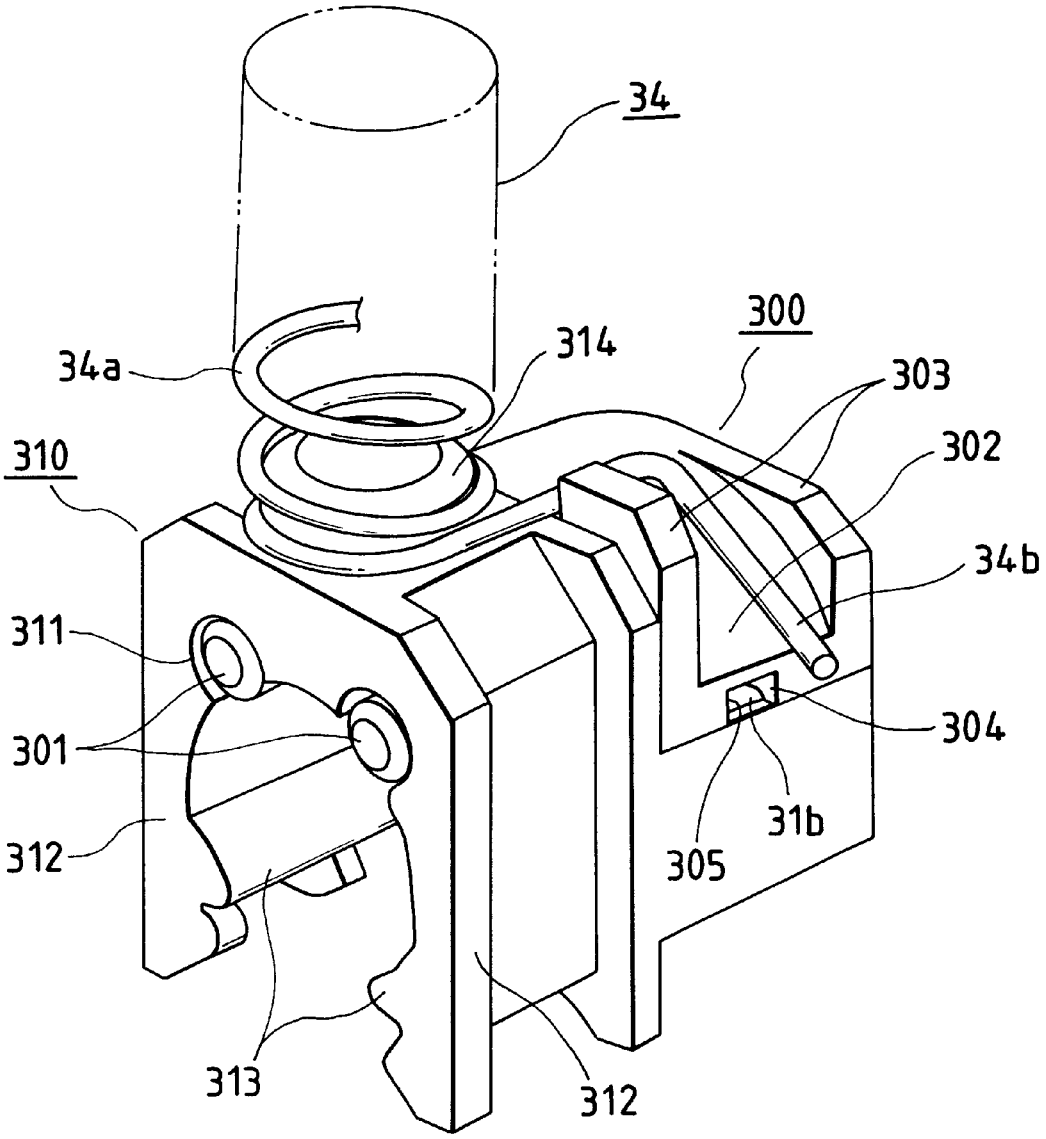
FIG. 7 is a perspective view illustrating the charging apparatus in the embodiment.

The first member 300 and the second member 310 are assembled so that the pair of charging roller contacting shafts 301 of the first member 300 are fitted in the pair of fitting grooves 311 of the second member 310, as shown in FIG. 7. On this occasion, the engagement pawls 316 of the second member 310, are fitted into the grooves 304 of the first member 300, and engagement surfaces 317 of the engagement pawls 316 come into contact with the engagement surfaces 305 of the groove 304, thereby preventing the first member 300 from being disengaged from the second member 310.

On the other hand, an arm portion 34*b*, of the armed coil spring 34, abuts against the spring arm abutment portion 302 of the first member 300, and a coil end surface on the side where the arm portion 34*b* is formed is then press-fitted in the coil spring fixing portion 314 of the second member 310 at an angle at which to enter between the pair of spring arm regulating ribs 303 of the spring arm abutment portion 302. On this occasion, the arm portion 34*b* of the armed coil spring 34 is elastically deformed, and abuts against the spring arm abutment portion 302 of the first member 300 with a predetermined abutting pressure.

Figure 12B:
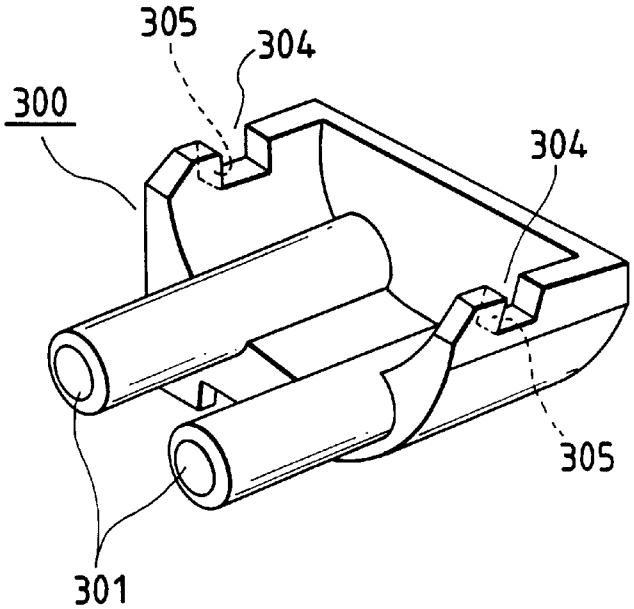
FIG. 12B is another enlarged perspective view showing the first holding member in the embodiment.
Figure 12A:
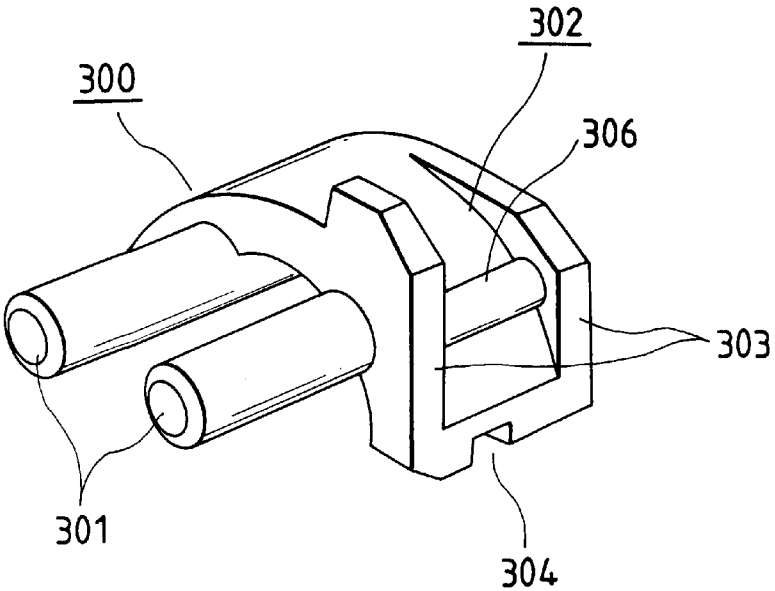
FIG. 12A is an enlarged perspective view showing a first holding member in the embodiment.

Note that the first member 300 may, as shown in FIGS. 12A and 12B, include a protrusion 306 formed in the area against which the arm portion 34*b* of the armed coil spring 34 abuts.

Figure 8C:
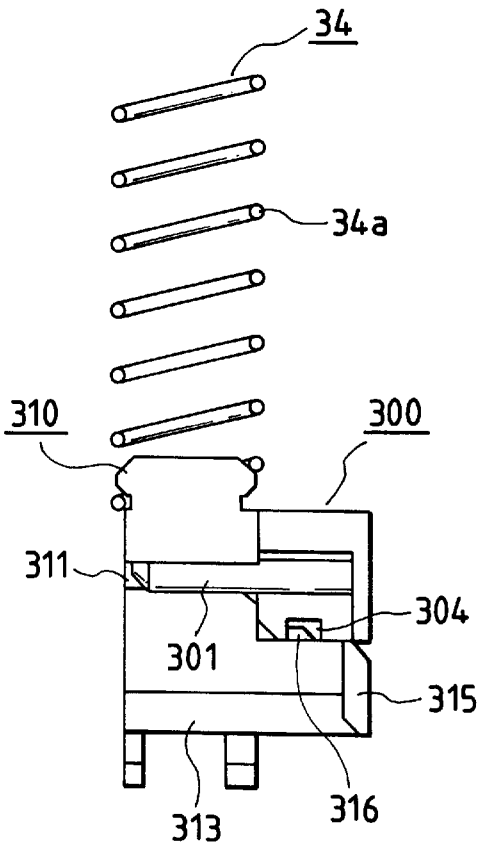
FIG. 8C is a sectional view showing the principal portion of the charging apparatus in Embodiment 1.
Figure 8B:
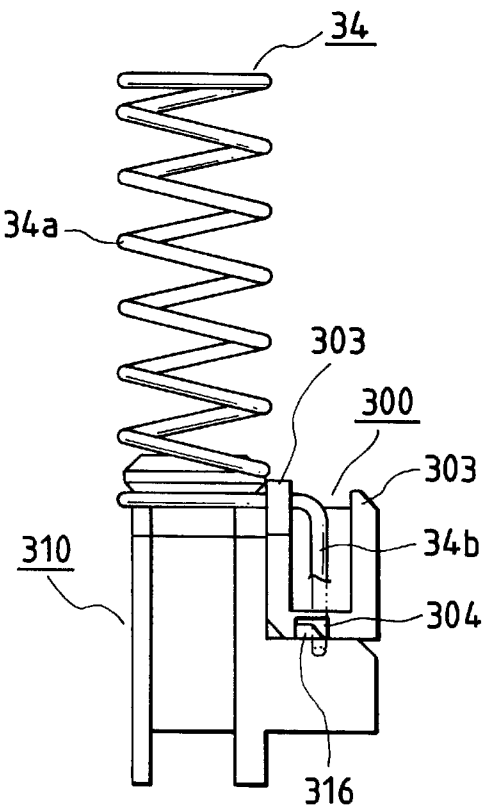
FIG. 8B is a side view showing the principal portion of the charging apparatus in embodiment 1.
Figure 8A:
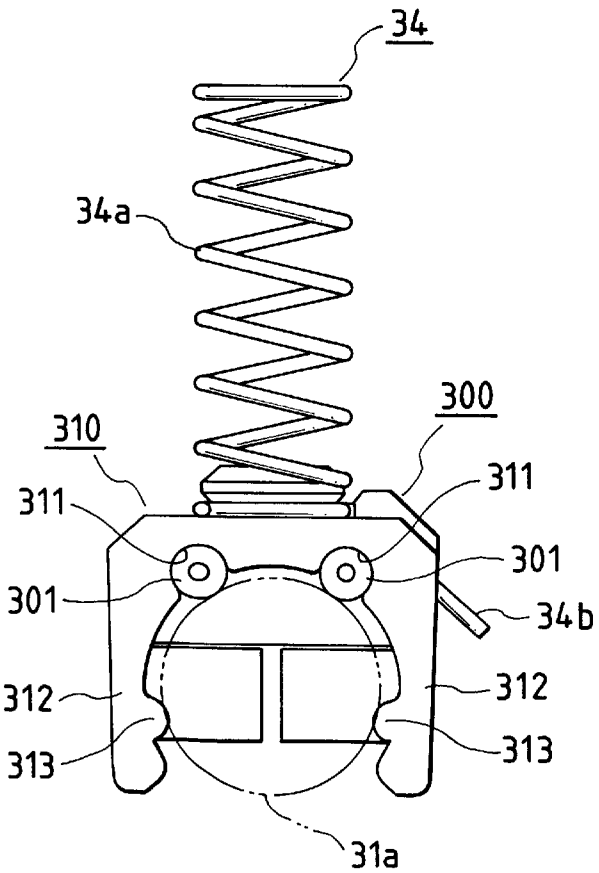
FIG. 8A is a front view showing the principal portion of the charging apparatus in Embodiment 1.
Figure 9:
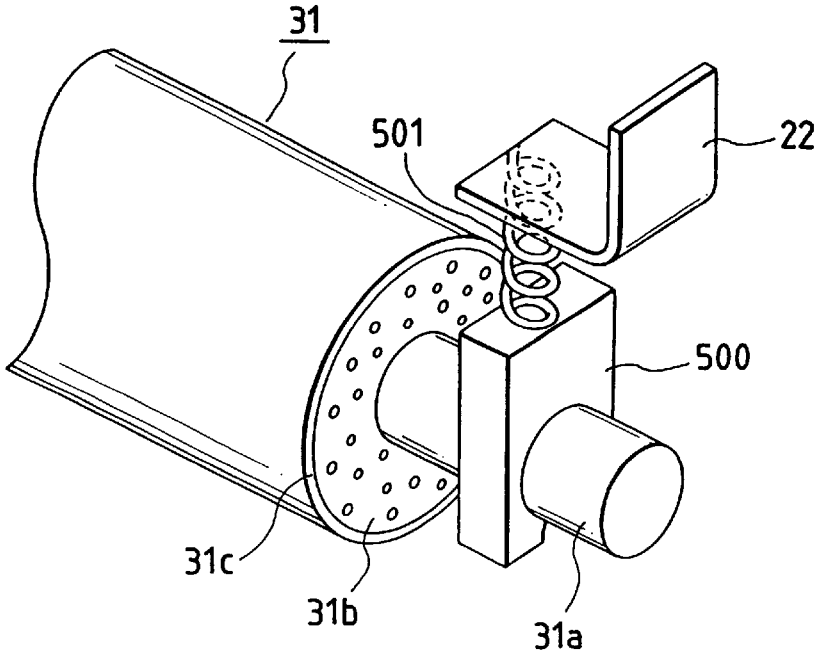
FIG. 9 PRIOR ART
FIG. 9 is a perspective view showing a charging apparatus in a first conventional art example.
Figure 10:
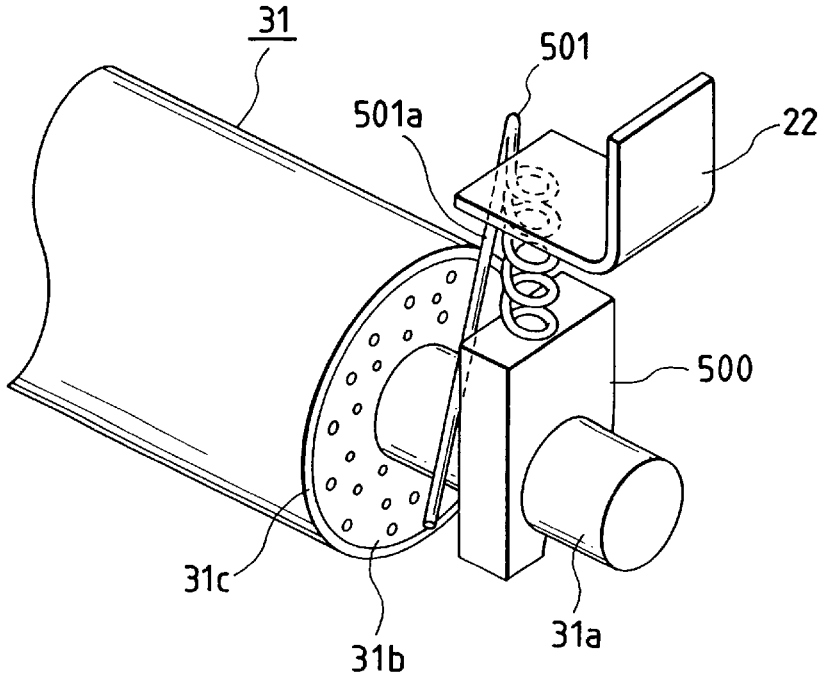
FIG. 10 PRIOR ART
FIG. 10 is a perspective view showing the charging apparatus in a second conventional art example.
Figure 11:
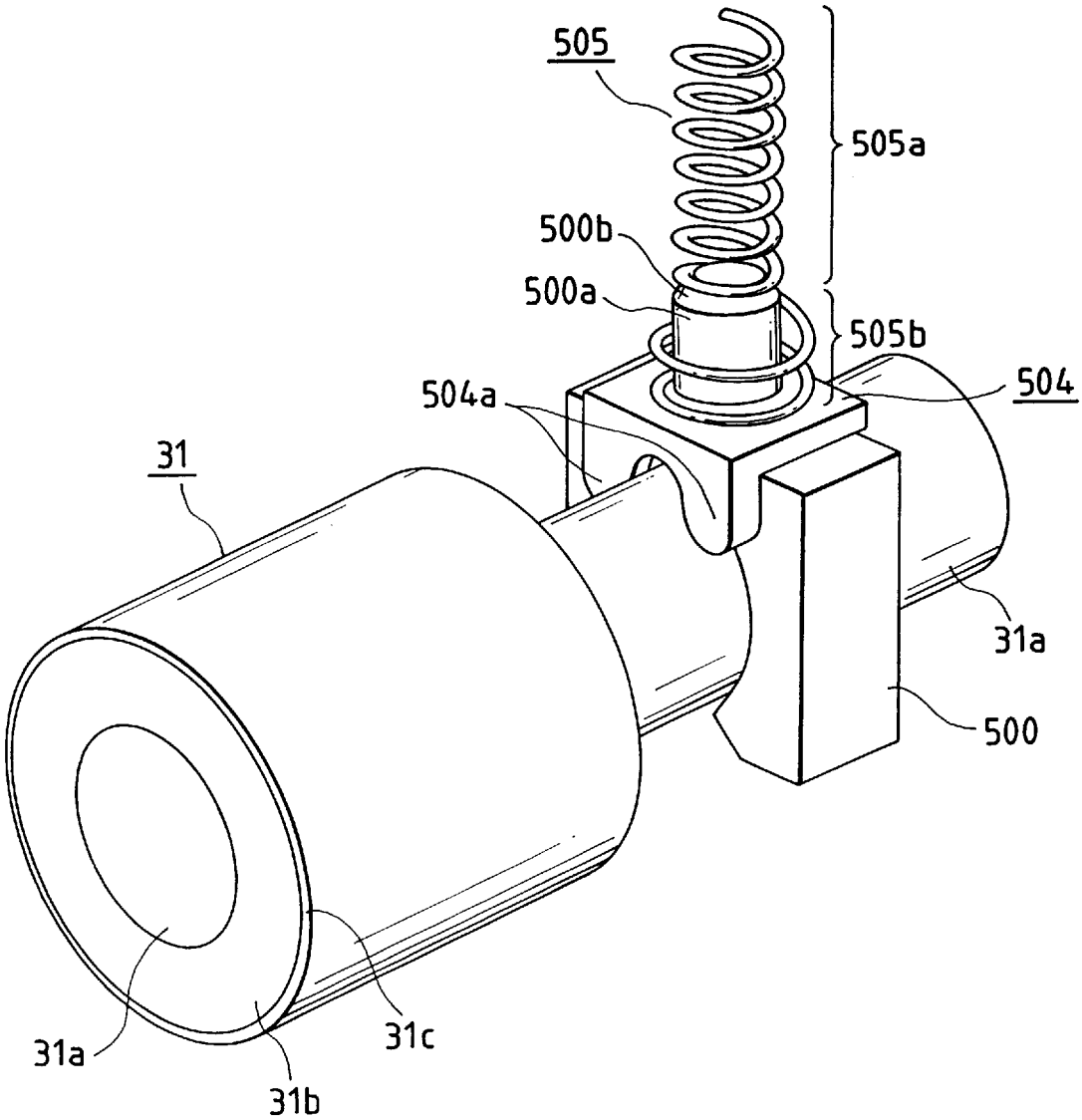
FIG. 11 PRIOR ART
FIG. 11 is a perspective view showing the charging apparatus in a third conventional art example.

Thus, one end of the core bar 31*a* of the charging roller 31 is rotatably secured to the holding member 32 with the first and second members 300 and 310 assembled. In this case, however, as shown in FIG. 8A, the core bar 31*a* is in contact with the pair of charging roller contacting shafts 301 of the first member 300, and is embraced by the shaft holding portions 312 of the second member 310, with respect to the pair of charging roller contacting shafts 301. Note, that an inscribed circle defined by the pair of charging roller contacting shafts 301, of the first member 300 and by the shaft contact portions 313 of the second member 310, is set smaller than an outside diameter of the core bar 31*a*, which is by an alternate long and two short dashes line, of the charging roller 31, and, when the core bar 31*a* is assembled, the second member 310 elastically deforms and contacts with the shaft 31*a* with a predetermined pressure.

When in the image forming process, as discussed above, the bias voltage is applied through the electric supply sheet metal 22. The electricity is supplied from a first electric supply path for supplying the electricity to the core bar 31*a* via the shaft contact portions 313, and the coil spring fixing portion 314, of the second member 310, from the armed coil spring 34, which is brought into contact with the electric supply sheet metal 22, and from a second electric supply path for supplying the electricity to the core bar 31*a* via the pair of charging roller contacting shafts 301 and the spring arm abutment portion 302 of the first member 300 from the arm 34*b* of the armed coil spring 34.

Especially, in the first embodiment, the position in which the second member 310 contacts with the charging member 31, is set so that a contacting pressure of the second member 310 with the charging roller 31, i.e., the charging member which is given by the elastic deformation of the second member 310, acts in such a direction as to press the charging member against the first member 300, thereby preventing the charging member 31 from coming off the holding member 32, as well as, preventing the holding member 32 from increasing in size by overlapping the contacting position of the first member 300 to the charging member 31, with the contacting position of the second member 310, to the charging member 31.

Further, the number of contacting portions between the first member 300 and the charging member 31, and the number of contacting portions between the second member 310 and the charging member 31, are set plural, thereby holding the charging member 31 more securely.

Furthermore, the contacting portions between the first member 300 and the charging member 31 are formed as the pair of cylindrical columns disposed in parallel to the rotary shaft of the charging member 31, and the second member 310 is formed with the pair of grooves into which the contacting portions (the pair of cylindrical columns) 301, can be fitted. Next, the engagement pawls 316 of the second member 310 engage with the engaging surfaces 305 of the first member 300, thereby enhancing a degree of how well the first member 300 and the second member 310 are assembled.

Others

The charging apparatus of the present invention is not limited to the apparatus for charging the body to be charged, which has been exemplified in the embodiment discussed above, but may be widely utilized as a transfer device, (e.g., the transfer charging roller 7 in FIG. 1), for transferring onto a recording material a toner image on the photosensitive body in the image forming apparatus, and as a device for removing charges from the charged body.

As discussed above, the voltage applying apparatus and the charging apparatus of the present invention are capable of:

(1) ensuring the electric supply to the charging member by providing the plurality of electric supply paths;

(2) downsizing the apparatus by overlapping the contacting position between the first member and the charging member with the contacting position between the second member and the charging member;

(3) facilitating the downsizing of the apparatus by contacting the second member to the charging member through the elastic deformation of the second member itself, and consequently, eliminating the necessity for the member, such as a spring, etc., for biasing the second member in order to make the second member contact with the charging member; and (4) facilitating the reuse of the second member, which involves preventing an abrasion thereof, by contacting the second member to the charging member with the predetermined pressure without depending on the resilient force of the elastic member.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation as illustrated and described. Accordingly, all suitable modifications and equivalents may be resorted to, falling within the scope of the invention.

What is claimed is:

1. A voltage applying apparatus for applying from a power source a voltage to a rotatable charging member for charging a body to be charged, comprising:

first and second conductive members brought into contact with a peripheral surface of a rotary shaft of said charging member to form a first electric supply path for applying the voltage to the peripheral surface of said rotary shaft through said first conductive member from said power source, and to form a second electric supply path for applying the voltage to the peripheral surface of said rotary shaft through said second conductive member from said power source, wherein a first portion at which said first conductive member is brought into contact with the peripheral surface of said rotary shaft and a second portion at which said second conductive member is brought into contact with the peripheral surface of said rotary shaft, are so provided as to be overlapped with each other in an axial direction of said rotary shaft, and wherein said second conductive member has an elasticity for interposing said rotary shaft therein so that a force interposing said rotary shaft presses said rotary shaft against said first conductive member.

2. A voltage applying apparatus according to claim 1, further comprising:

a biasing member for biasing said first conductive member toward the peripheral surface of said rotary shaft, wherein by a biasing force of said biasing member, said charging member is biased toward said body to be charged.

3. A voltage applying apparatus according to claim 2, wherein said biasing member forms part of said first electric supply path between said power source and said first conductive member, and part of said second electric supply path between said power source and said second conductive member.

4. A voltage applying apparatus according to claim 3, wherein said biasing member biases said second conductive member toward said rotary shaft.

5. A voltage applying apparatus according to claim 4, wherein said first portion is pressed between said second conductive member and the peripheral surface of said rotary shaft by the biasing force of said biasing member.

6. A voltage applying apparatus according to claim 3, wherein said biasing member includes a coil portion for biasing said second conductive member and an arm portion for biasing said first conductive member.

7. A voltage applying apparatus according to claim 2, wherein said biasing member is a coil-like spring.

8. A voltage applying apparatus according to claim 1, wherein a plurality of said first portions are provided.

9. A voltage applying apparatus according to claim 1, wherein said first portion extends parallel to said rotary shaft.

10. A voltage applying apparatus according to claim 1, wherein said first conductive member engages with said second conductive member.

11. A voltage applying apparatus according to claim 1, wherein said second conductive member is provided more inward than said first conductive member in an axial direction of said rotary shaft.

12. A voltage applying apparatus according to claim 11, wherein said second conductive member includes a stopper for regulating an axial movement of said rotary shaft.

13. A voltage applying apparatus according to claim 1, wherein said first and second conductive members are composed of resin.

14. A charging apparatus for charging a body to be charged, comprising:

a rotatable charging member, contactable with said body to be charged, for charging said body to be charged; and a voltage applying apparatus for applying a voltage to said charging member from a power source:

said voltage applying apparatus comprising:

first and second conductive members brought into contact with a peripheral surface of a rotary shaft of said charging member; and a biasing member for biasing said first conductive member toward said rotary shaft of said charging member, said voltage applying apparatus being formed with a first electric supply path for applying the voltage to the peripheral surface of said rotary shaft through said biasing member and said first conductive member from said power source, and with a second electric supply path for applying the voltage to the peripheral surface of said rotary shaft through said biasing member and said second conductive member from said power source, wherein a first portion at which said first conductive member is brought into contact with the peripheral surface of said rotary shaft and a second portion at which said second conductive member is brought into contact with the peripheral surface of said rotary shaft, are so provided as to be overlapped with each other in an axial direction of said rotary shaft, and wherein said second conductive member has an elasticity for interposing said rotary shaft therein so that a force interposing said rotary shaft presses said rotary shaft against said first conductive member.

15. A charging apparatus according to claim 14, wherein by the biasing force of said biasing member, said charging member is biased toward said body to be charged.

16. A charging apparatus according to claim 15, wherein said biasing member biases said second conductive member toward said rotary shaft.

17. A charging apparatus according to claim 16, wherein said first portion is pressed between said second conductive member and the peripheral surface of said rotary shaft by the biasing force of said biasing member.

18. A charging apparatus according to claim 16, wherein said biasing member includes a coil portion for biasing said second conductive member and an arm portion for biasing said first conductive member.

19. A charging apparatus according to claim 14, wherein a plurality of said first portions are provided.

20. A charging apparatus according to claim 14, wherein said first portion extends parallel to said rotary shaft.

21. A charging apparatus according to claim 14, wherein said first conductive member engages with said second conductive member.

22. A charging apparatus according to claim 14, wherein said biasing member is a coil-like spring.

23. A charging apparatus according to claim 14, wherein said second conductive member is provided more inward than said first conductive member in an axial direction of said rotary shaft.

24. A charging apparatus according to claim 23 wherein said second conductive member includes a stopper for regulating an axial movement of said rotary shaft.

25. A charging apparatus according to claim 14, wherein said first and second conductive members are composed of resin.

26. A charging apparatus according to any one of claims 14 through 17, or 19 through 25, wherein said body to be charged is an image bearing member for bearing an image, and said image bearing member and said charging apparatus are provided into a process cartridge attachable to and detachable from an image forming apparatus.

27. A charging apparatus according to any one of claims 14 through 17, or 19 through 25, wherein said body to be charged is an image bearing member for bearing an image, and said charging apparatus charges said image bearing member before an electrostatic image is formed on said image bearing member.

* * * * *

UNITED STATES PATENT AND TRADEMARK OFFICE

CERTIFICATE OF CORRECTION

PATENT NO. : 6,144,819

DATED : November 7, 2000

INVENTOR(S) : Tsutomu NISHIUWATOKO

It is certified that error appears in the above-identified patent and that said Letters Patent is hereby corrected as shown below:

COLUMN 1:

Line 27, "predetermine" should read --predetermined--; and
Line 54, "resilient a coil" should read --resilient coil--.

COLUMN 10:

Line 31, "claim 23" should read --claim 23,--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*